US007598662B2

(12) United States Patent
Miki et al.

(10) Patent No.: US 7,598,662 B2
(45) Date of Patent: Oct. 6, 2009

(54) LOW-PRESSURE MERCURY VAPOR LAMP WITH AN ADHERING UNIT TO IMPROVE LUMINOUS EFFICIENCY

(75) Inventors: Masahiro Miki, Ibaraki (JP); Hiroki Kitagawa, Kusatsu (JP)

(73) Assignee: Panasonic Corporation, Osaka (JP)

( * ) Notice: Subject to any disclaimer, the term of this patent is extended or adjusted under 35 U.S.C. 154(b) by 328 days.

(21) Appl. No.: 11/075,971

(22) Filed: Mar. 9, 2005

(65) Prior Publication Data

US 2005/0206292 A1 Sep. 22, 2005

(30) Foreign Application Priority Data

Mar. 16, 2004 (JP) ..... 2004-074287
Mar. 3, 2005 (JP) ..... 2005-058495

(51) Int. Cl.
*H01J 9/00* (2006.01)
*H01J 17/16* (2006.01)
*H01J 61/30* (2006.01)

(52) U.S. Cl. ..... 313/318.08; 313/11; 313/113; 313/492; 315/58; 362/294; 362/216; 362/260

(58) Field of Classification Search ..... 313/565, 313/318, 639, 58, 318.01–318.04; 445/24–25; 315/32, 51
See application file for complete search history.

(56) References Cited

U.S. PATENT DOCUMENTS 4,720,656 A * 1/1988 Johnston et al. ..... 313/493
5,541,477 A * 7/1996 Maya et al. ..... 313/493
5,828,185 A * 10/1998 Fellows et al. ..... 315/246
6,172,452 B1 * 1/2001 Itaya et al. ..... 313/490
6,367,947 B1 * 4/2002 Itaya et al. ..... 362/216
6,538,379 B2 * 3/2003 Taniguchi et al. ..... 313/573
6,734,633 B2 * 5/2004 Matsuba et al. ..... 315/58
7,074,104 B2 * 7/2006 Itaya et al. ..... 445/26
2001/0024090 A1 * 9/2001 Kraus et al. ..... 313/639
2002/0024814 A1 * 2/2002 Matsuba et al. ..... 362/294
2002/0101164 A1 * 8/2002 Yan ..... 315/58
2002/0158567 A1 * 10/2002 Arakawa et al. ..... 313/492
2002/0167264 A1 * 11/2002 Nishio et al. ..... 313/493
2003/0034737 A1 * 2/2003 Moench et al. ..... 315/32
2003/0071556 A1 * 4/2003 Itaya et al. ..... 313/318.08
2003/0080691 A1 * 5/2003 Yasuda et al. ..... 315/169.3
2003/0230979 A1 * 12/2003 Busai et al. ..... 313/565
2005/0231120 A1 * 10/2005 Kitagawa et al. ..... 315/56
2006/0244359 A1 * 11/2006 Kang ..... 313/493

FOREIGN PATENT DOCUMENTS

JP 07-074287 3/1995

* cited by examiner

*Primary Examiner*—Sikha Roy
*Assistant Examiner*—Tracie Green

(57) ABSTRACT

A compact self-ballasted fluorescent lamp includes a double-spiral arc tube and a holder. The holder has a tubular protrusion which is surrounded by the arc tube, at a center of its main surface. A closed end of the protrusion and a part of the arc tube facing the end of the protrusion are bonded together using a silicone adhesive. A part of a vertical printed circuit board that is used as a lighting circuit is housed within the protrusion.

14 Claims, 6 Drawing Sheets

LOW-PRESSURE MERCURY VAPOR LAMP WITH AN ADHERING UNIT TO IMPROVE LUMINOUS EFFICIENCY

This application is based on applications Nos. 2004-074287 and 2005-058495 filed in Japan, the contents of which are hereby incorporated by reference.

BACKGROUND OF THE INVENTION

1. Field of the Invention

The present invention relates to techniques of reducing in size of a low-pressure mercury vapor lamp such as a compact self-ballasted fluorescent lamp having an arc tube which forms a curved discharge path, without causing an operational failure and a productivity decrease.

2. Related Art

Compact self-ballasted fluorescent lamps that include an arc tube having a curved discharge path are being actively developed in recent years. Examples of an arc tube having a curved discharge path include a U-type arc tube in which a plurality of U-shaped glass bulbs are connected to form one discharge path, and a spiral-type arc tube in which a straight glass bulb is wound in a double spiral.

Such an arc tube is held by a holder so as to be in a standing condition. In detail, the arc tube is held by the holder by bonding both ends of the arc tube to an underside of the holder, i.e. an opposite side of the holder to the arc tube, using a silicone adhesive or the like. An electronic lighting circuit (hereafter simply referred to as "lighting circuit") is fixed to the underside of the holder, too. A case is attached to the holder so as to cover this lighting circuit.

To further downsize such compact self-ballasted fluorescent lamps, Japanese Patent Application Publication No. H07-085708 discloses the following construction. A protrusion that protrudes into a space surrounded by the arc tube is formed at a center of a top surface of the holder, and a part of the lighting circuit is housed within this protrusion. In this construction, an opening of the holder from the underside into the protrusion has a diameter enough to insert the part of the lighting circuit from the underside into the protrusion.

There is a growing demand for reduction in size of compact self-ballasted fluorescent lamps, as well as other lighting apparatuses. Accordingly, the holder and the case in compact self-ballasted fluorescent lamps tend to be downsized year after year. Meanwhile, there is a limit in downsizing of the lighting circuit, and so the diameter of the opening from the underside into the protrusion remains unchanged. As a result, the opening occupies a large area of the holder, thereby making it impossible to secure a sufficient area for bonding the ends of the arc tube.

In such a case, if a required amount of silicone adhesive is injected to bond the holder and the ends of the arc tube together, the silicone adhesive flows from the opening into the protrusion and adheres to circuit components housed in the protrusion. This causes problems such as an operational failure and a productivity decrease. To avoid this situation, a sufficient area for bonding the ends of the arc tube needs to be secured. This, however, causes the diameter of the opening to decrease, which makes it impossible to insert the part of the lighting circuit into the protrusion.

SUMMARY OF THE INVENTION

In view of the above problems, the present invention aims to provide a low-pressure mercury vapor lamp that is reduced in size without an operational failure and a loss of productivity.

The stated aim can be achieved by a low-pressure mercury vapor lamp including: an arc tube having electrodes at both ends and for forming one curved discharge path inside; a holder having two openings in which the ends of the arc tube are respectively inserted, and a tubular protrusion that is surrounded by the arc tube; and a bonding unit bonding the arc tube and the protrusion of the holder together.

With this construction, the arc tube is bonded to the protrusion of the holder. Accordingly, the arc tube can be stably held at three locations, i.e. the location where the arc tube is bonded to the protrusion of the holder and the two locations where the ends of the arc tube are inserted in the openings of the holder.

Here, the ends of the arc tube may be inserted in the openings of the holder without being bonded to the holder.

With this construction, problems caused by an adhesive such as a silicone adhesive flowing into the protrusion can be avoided. Since the ends of the arc tube need not be bonded to the holder, the low-pressure mercury vapor lamp can further be reduced in size.

Here, the protrusion may have a closed end, wherein the bonding unit bonds the end of the protrusion to a part of the arc tube facing the end of the protrusion.

With this construction, heat emitted from the other parts of the arc tube can be conducted to a coldest spot of the arc tube via the protrusion of the holder. This increases the temperature of the coldest spot, which causes an increase in mercury vapor pressure. As a result, a higher luminous flux can be produced.

Here, the bonding unit may bond a side of the protrusion to a part of the arc tube facing the side of the protrusion.

With this construction, heat emitted from the other parts of the arc tube can be more efficiently conducted to the coldest spot of the arc tube to thereby increase the temperature of the coldest spot.

Here, a part of the protrusion that is bonded by the bonding unit may have an irregular surface.

According to this construction, the arc tube is held by the holder more securely.

Here, the low-pressure mercury vapor lamp may further include a lighting circuit having a choke coil and a transistor, wherein at least one of the choke coil and the transistor is positioned inside the protrusion.

The choke coil and the transistor have high upper temperature limits. Accordingly, the low-pressure mercury vapor lamp can be reduced in size by providing these circuit components in the protrusion, without causing an operational failure during lighting.

Here, the at least one of the choke coil and the transistor may be in contact with an inner wall of the protrusion.

With this construction, heat emitted from the choke coil and the like is allowed to escape to the protrusion, with it being possible to prevent an operational failure more reliably.

Here, the low-pressure mercury vapor lamp may further include a lighting circuit having a voltage doubler that includes an electrolytic capacitor, wherein the electrolytic capacitor is positioned inside the protrusion.

With this construction, when the arc tube reaches the end of its life, heat emitted from the arc tube disables the electrolytic capacitor. In this way, the lighting circuit can be stopped safely.

Here, the electrolytic capacitor may be in contact with an inner wall of the protrusion.

With this construction, heat emitted from the electrolytic capacitor is allowed to escape to the protrusion, to keep the electrolytic capacitor from being disabled by heat before the arc tube reaches the end of its life.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes an embodiment of a low-pressure mercury vapor lamp of the present invention, with reference to the drawings. In the following description, a compact self-ballasted fluorescent lamp is used as an example low-pressure mercury vapor lamp.

1. Construction of a Compact Self-Ballasted Fluorescent Lamp

Figure 1:
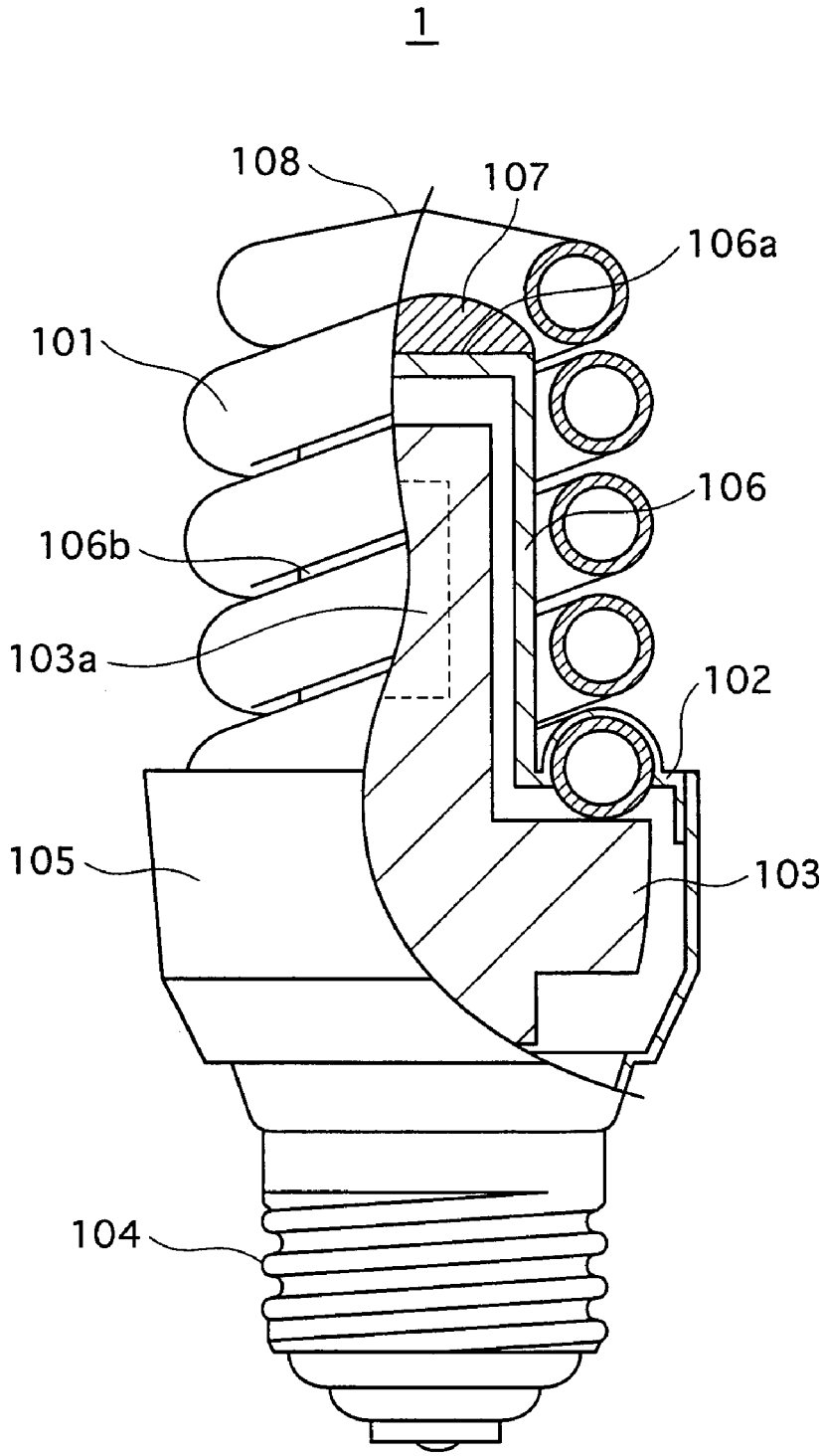
FIG. 1 is a partial cutaway front view of a compact self-ballasted fluorescent lamp according to an embodiment of the present invention.

FIG. 1 is a partial cutaway front view of a compact self-ballasted fluorescent lamp 1 to which the embodiment of the present invention relates. This compact self-ballasted fluorescent lamp 1 corresponds to a 40 W incandescent lamp. As shown in the drawing, the compact self-ballasted fluorescent lamp 1 includes an arc tube 101, a holder 102 having a protrusion 106, a lighting circuit 103, a base 104, a case 105, and a bonding unit 107.

The arc tube 101 is formed by bending a straight glass tube in a double spiral. Electrodes (not illustrated) are sealed at both ends of the arc tube 101. A phosphor is applied to an inner wall of the arc tube 101. The phosphor referred to here is a three-band phosphor as an example. About 5 mg of mercury is enclosed in the arc tube 101. Also, argon is enclosed in the arc tube 101 at about 550 Pa as a buffer gas. Here, the mercury is enclosed such that a substantially same mercury vapor pressure as when mercury is enclosed in a substantially single form is obtained during the operation of the arc tube 101. This can be achieved by enclosing mercury in a substantially single form or in other forms, such as tin mercury and zinc mercury, that exhibit a similar mercury vapor pressure to a substantially single form during operation, in a manufacturing process of the arc tube 101. For instance, an inside diameter of the arc tube 101 is 5 mm, a distance between the electrodes is 300 mm, and a number of turns in each of the two spirals of the arc tube 101 is about 3.5.

Figure 2:
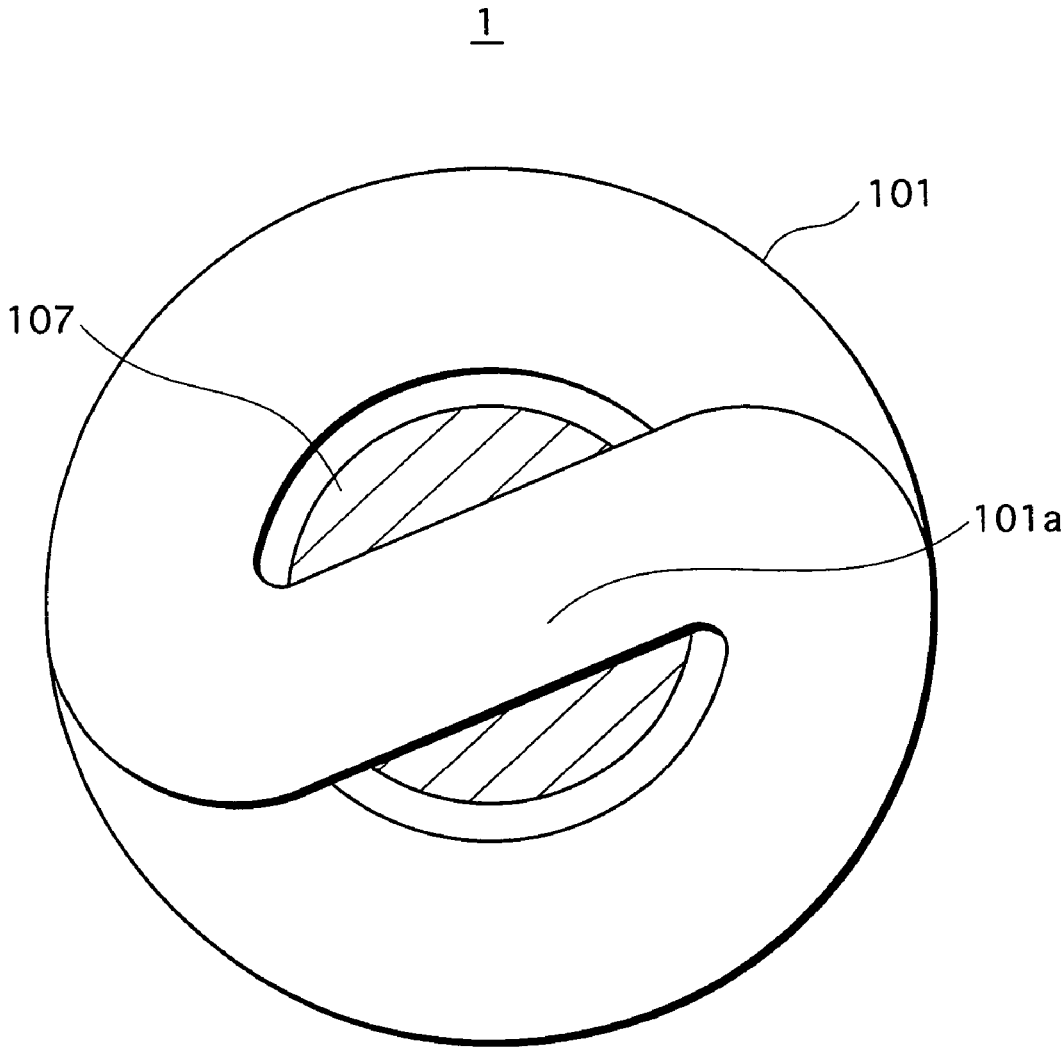
FIG. 2 is a top view of the compact self-ballasted fluorescent lamp shown in FIG. 1.

FIG. 2 shows the arc tube 101 as viewed from the opposite side to the base 104. The arc tube 101 is turned at a turning part 101*a* that is located farthest from the base 104. The bonding unit 107 bonds the arc tube 101 to the protrusion 106 of the holder 102 (explained later in detail).

If the arc tube 101 is covered with a globe (not illustrated), a projection may be formed on top of the turning part 101*a*. This projection serves as a coldest-spot part 108 that is expected to be lowest in temperature during the operation of the arc tube 101. The mercury vapor pressure during operation is determined by the temperature at this coldest-spot part 108.

The holder 102 holds both ends of the arc tube 101. The case 105 is shaped like a funnel, and attached to the holder 102 so as to cover the lighting circuit 103. The base 104 is fixed to the case 105.

The lighting circuit 103 is a vertical printed circuit board as an example. A main surface of the lighting circuit 103 is set orthogonal to a main surface of the holder 102. In other words, the main surface of the lighting circuit 103 is set in parallel with a longitudinal direction of the compact self-ballasted fluorescent lamp 1. The lighting circuit 103 employs a series-inverter method. The lighting circuit 103 is disposed on an underside of the holder 102, with a part of the lighting circuit 103 being housed inside the protrusion 106. The part of the lighting circuit 103 housed inside the protrusion 106 includes a choke coil 103*a*. The choke coil 103*a* is positioned within about 3 mm from an end 106*a* of the protrusion 106, and may be in contact with the end 106*a*.

The protrusion 106 has a tubular shape with the end 106*a* which is closed, and protrudes in a space surrounded by the arc tube 101. The end 106*a* of the protrusion 106 is attached to the turning part 101*a* of the arc tube 101 through the bonding unit 107. For example, the bonding unit 107 is made of a resin adhesive such as a silicone adhesive.

The protrusion 106 and the arc tube 101 have a sufficient distance for the end 106*a* and the protrusion 106 side of the turning part 101*a* to adhere to each other. The space surrounded by the arc tube 101, i.e. the space in which the protrusion 106 is positioned, is about 20 mm in diameter. Meanwhile, the protrusion 106 has an outside diameter of about 18 mm. Hence a distance between the protrusion 106 and the arc tube 101 is about 1 mm.

2. Method of Bonding the Arc Tube 101 and the Protrusion 106

For example, the arc tube 101 and the protrusion 106 may be bonded together by injecting the adhesive of the bonding unit 107 from a nozzle (not illustrated) which is inserted through a gap of the arc tube 101. Alternatively, the arc tube 101 and the protrusion 106 may be bonded together by forming the bonding unit 107 on the protrusion 106 and then inserting the protrusion 106 into the space surrounded by the arc tube 101.

3. Effects

In general, the mercury vapor pressure in an arc tube is higher if the temperature of the coldest spot of the arc tube is higher. If the temperature of the coldest spot is excessively low, the mercury vapor pressure drops and as a result the luminous flux decreases. If the temperature of the coldest spot is excessively high, on the other hand, the mercury vapor pressure rises to an excessive degree, which causes the luminous flux to decrease, too. Accordingly, the mercury vapor pressure needs to be brought to an optimum level to maximize the luminous flux.

In the compact self-ballasted fluorescent lamp 1 of this embodiment, heat emitted from the arc tube 101 during lighting raises the temperature of the protrusion 106. This heat is further conducted to the coldest-spot part 108 through the bonding unit 107. As a result, the temperature of the coldest spot increases, which contributes to a higher luminous flux.

Also, the choke coil 103*a* which produces a largest amount of heat in the lighting circuit 103 is positioned near the end 106*a* of the protrusion 106. Heat emitted from this choke coil 103*a* contributes to a higher temperature of the coldest spot and a higher luminous flux, too.

For instance, a small, low-wattage fluorescent lamp with a thin arc tube and a low lamp current (e.g. a 40 W fluorescent lamp) cannot raise the temperature of the coldest spot to a sufficient level and therefore cannot produce a high luminous flux. According to this embodiment, on the other hand, a high luminous flux can be attained without an increase in power consumption.

Also, according to this embodiment the arc tube 101 is held by bonding the arc tube 101 to the protrusion 106 of the holder 102 using the bonding unit 107. This makes it unnecessary to bond both ends of the arc tube 101 to the holder 102. Even if both ends of the arc tube 101 are bonded to the holder 102, such bonding requires a smaller amount of adhesive than in the conventional techniques. Hence the problems encountered by the conventional techniques, such as the adhesive flowing into the protrusion and adhering to circuit components or the lighting circuit being unable to be inserted into the protrusion due to the bonding between the ends of the arc tube and the holder, can be avoided. This means an operational failure and a productivity drop resulting from such problems will not occur, with it being possible to produce compact self-ballasted fluorescent lamps stably in large quantities.

4. Modifications

The present invention has been described by way of the above embodiment, though it should be obvious that the present invention is not limited to the above. Example modifications are given below.

(1) If a voltage doubler is used for the lighting circuit, an electrolytic capacitor in the lighting circuit may be positioned inside the protrusion. When the arc tube approaches the end of its life, heat generated from the arc tube disables this electrolytic capacitor, thereby stopping the operation of the lighting circuit safely.

In this case, the temperature in the protrusion need be regulated so as not to exceed an upper temperature limit of the electrolytic capacitor before the arc tube reaches the end of its life, since the electrolytic capacitor is heat-sensitive. Here, if the electrolytic capacitor is positioned in contact with the protrusion, heat of the electrolytic capacitor is allowed to escape to the protrusion, with it being possible to improve the heat dissipation of the circuit component. Hence a normal operation of the electrolytic capacitor can be ensured.

(2) A transistor in the lighting circuit may be positioned inside the protrusion, so as to be within 3 mm from or in contact with the end of the protrusion.

Conventionally, a transistor is housed within a case. In recent years, however, the distance between the transistor and an electrode portion of an arc tube decreases as the case is reduced in size. The electrode portion of the arc tube reaches as high as about 1000° C. during lighting. This being so, if the distance between the transistor and the electrode portion decreases, heat generated from the electrode portion shortens the life of the transistor.

According to this modification, the transistor is situated away from the electrode portion of the arc tube, so that a loss of life of the transistor caused by the heat of the electrode portion can be avoided. In addition, heat emitted from the transistor itself is efficiently conducted to the coldest-spot part, which contributes to a higher luminous flux.

(3) The above embodiment describes the case where the bonding unit is applied solely to the end of the protrusion, but the present invention is not limited to this. For example, the following modification may be used.

Figure 3:
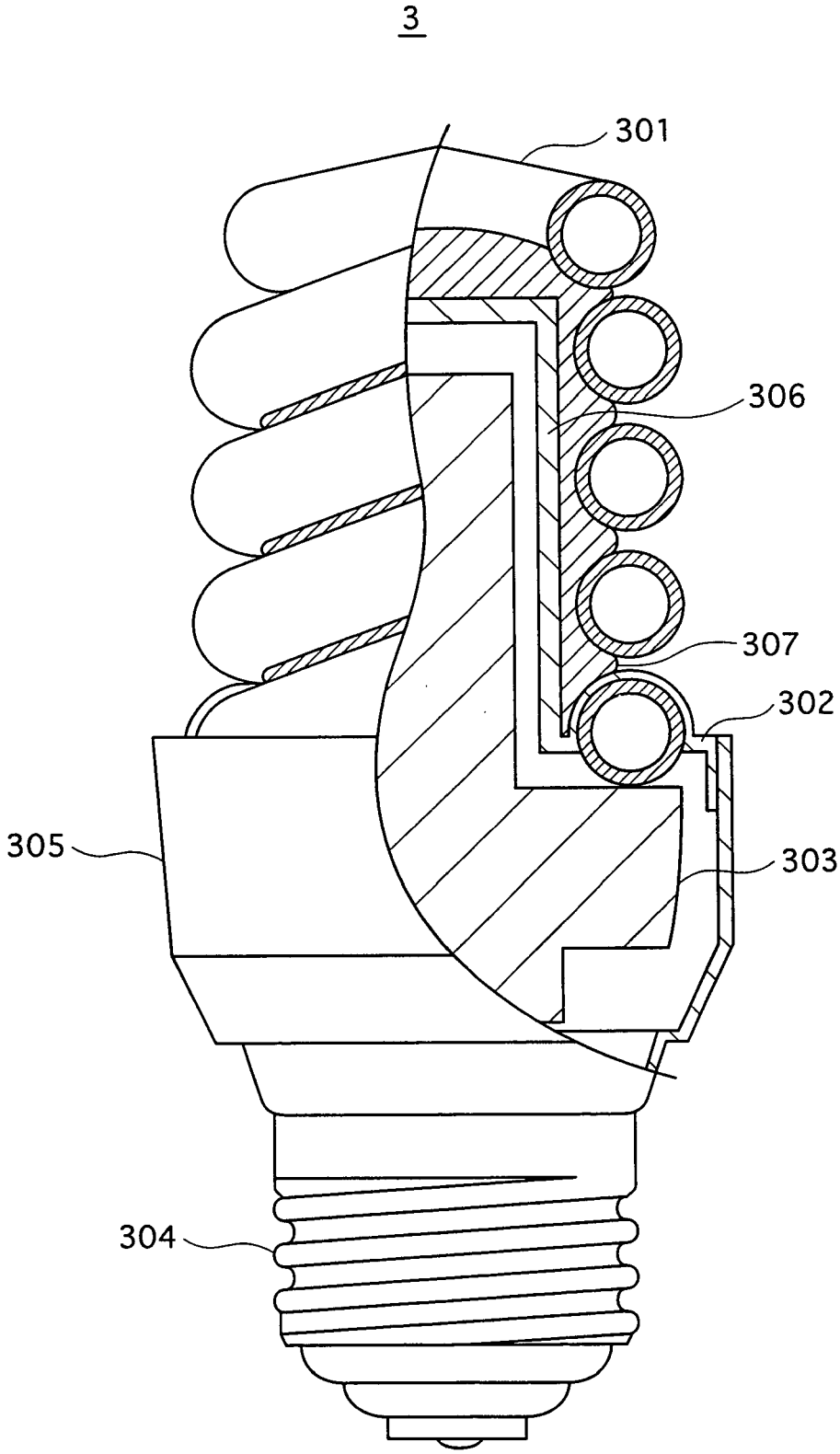
FIG. 3 is a partial cutaway front view of a compact self-ballasted fluorescent lamp according to a modification (3) to the embodiment.

FIG. 3 is a partial cutaway front view of a compact self-ballasted fluorescent lamp 3 to which this modification relates. As illustrated, the compact self-ballasted fluorescent lamp 3 includes an arc tube 301, a holder 302 having a protrusion 306, a lighting circuit 303, a base 304, a case 305, and a bonding unit 307. The bonding unit 307 is made of a silicone adhesive or the like, and bonds an end and a side of the protrusion 306 to the arc tube 301.

It should be obvious here that the side of the protrusion 306 and the side of the arc tube 301 have a sufficient distance for adhering to each other. The bonding unit 307 is formed by injecting the adhesive from a nozzle which is inserted through a gap of the arc tube 301.

This construction enables the bonding unit 307 to have a large contact area with both the arc tube 301 and the protrusion 306, so that the arc tube 301 can be attached to and held by the holder 302 more reliably. The bonding unit 307 made of a silicone adhesive has elasticity. Such a bonding unit 307 can absorb a shock that may be given to the case 305 or the like, thereby preventing damage to the arc tube 301.

If the bonding unit 307 is made of a transparent material, light from the arc tube 301 will not be blocked by the bonding unit 307. Hence a drop in luminous efficiency can be suppressed easily. As an alternative, the bonding unit 307 may be disposed in an area that will not block light from the arc tube 301.

(4) The above embodiment describes a compact self-ballasted fluorescent lamp having a double-spiral arc tube as one example, but this is not a limit for the present invention.

Figure 4:
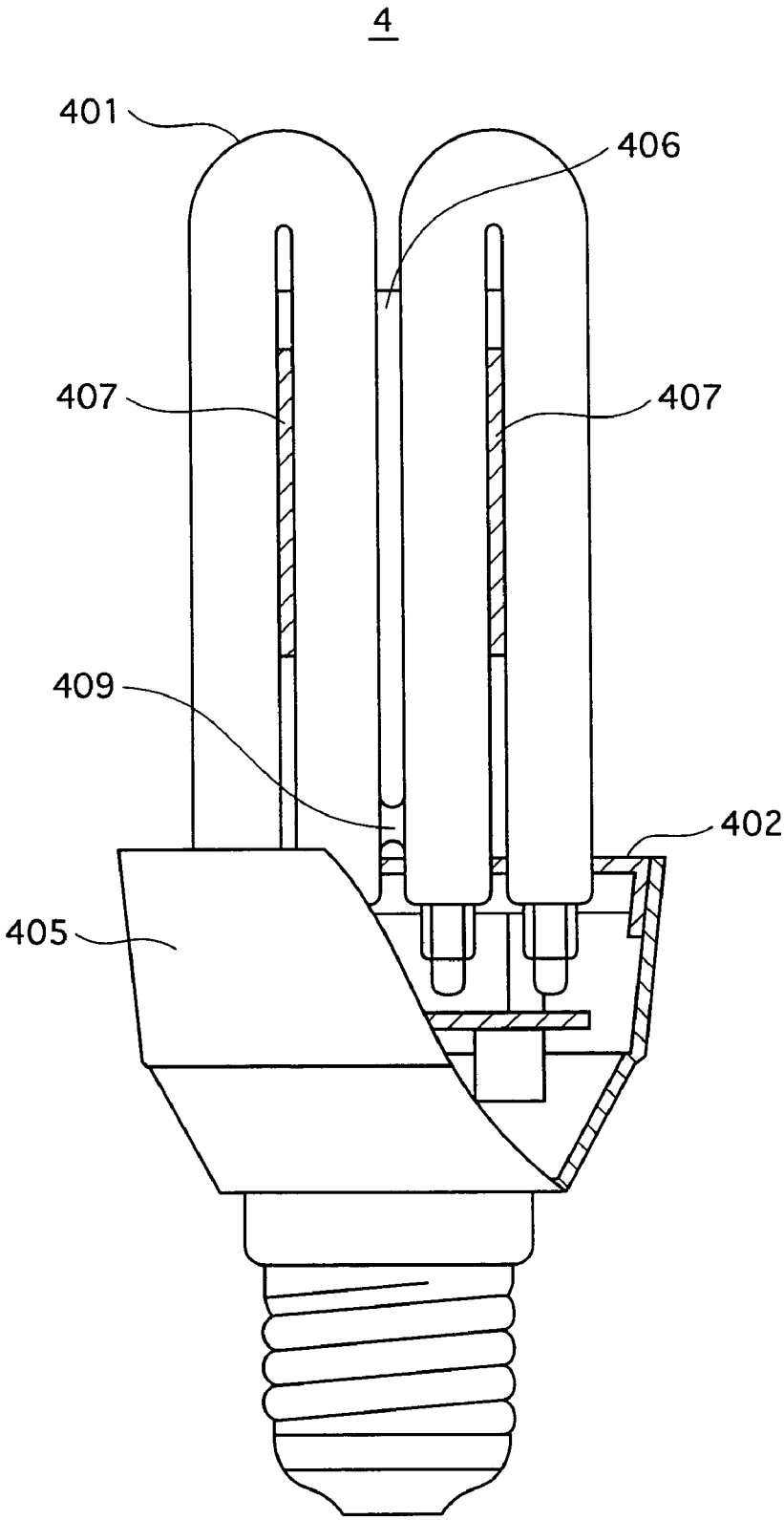
FIG. 4 is a partial cutaway front view of a compact self-ballasted fluorescent lamp according to a modification (4) to the embodiment.
Figure 5:
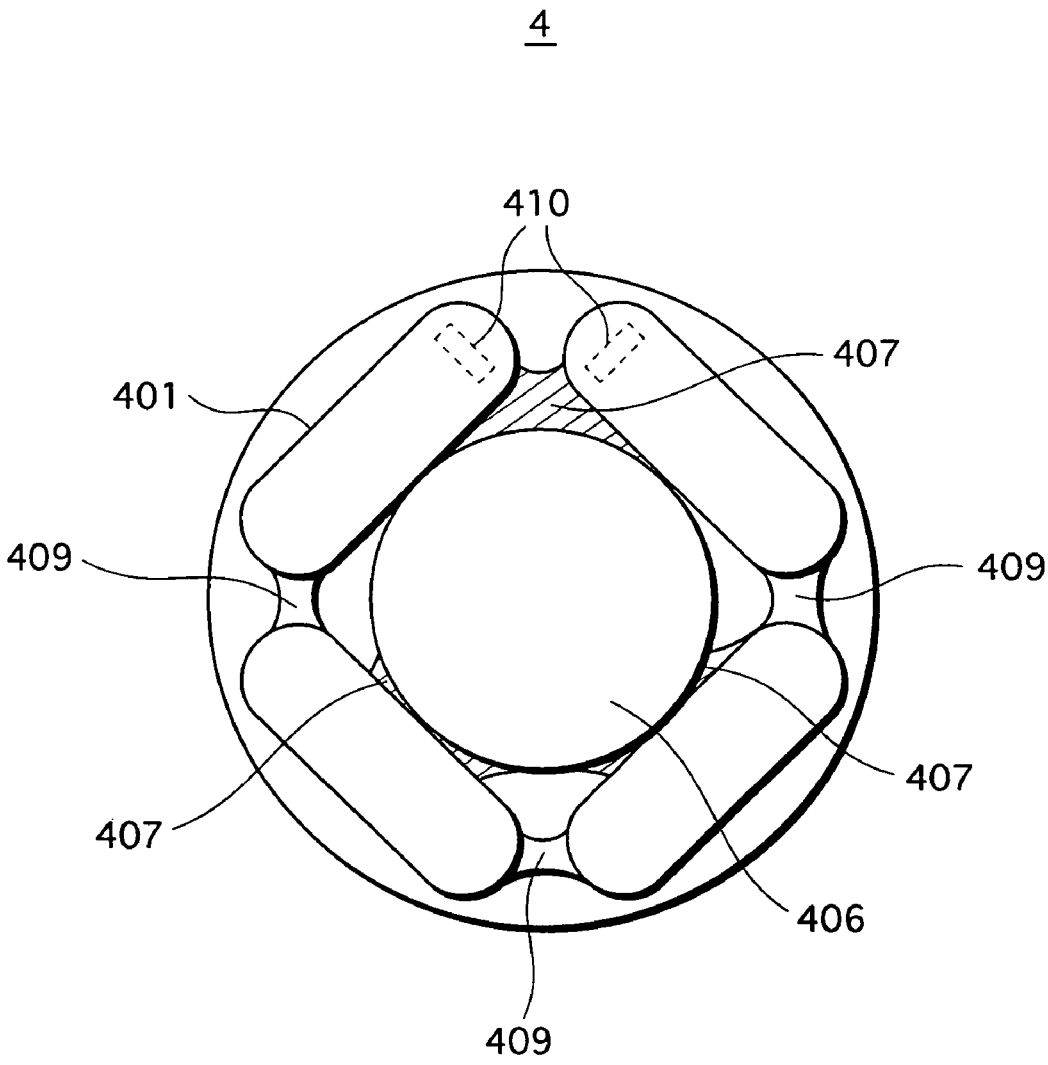
FIG. 5 is a top view of the compact self-ballasted fluorescent lamp shown in FIG. 4.

FIG. 4 is a partial cutaway front view of a compact self-ballasted fluorescent lamp 4 to which this modification relates. As shown in the drawing, the compact self-ballasted fluorescent lamp 4 includes an arc tube 401, a holder 402 having a protrusion 406, a case 405, a bonding unit 407, and a bridge connection unit 409. The arc tube 401 is formed by bridge-connecting four U-shaped glass bulbs by the bridge connection unit 409. FIG. 5 is a top view of the compact self-ballasted fluorescent lamp 4 as viewed from the opposite side to a base. In FIG. 5, broken lines 410 indicate electrodes equipped in the arc tube 401.

In this compact self-ballasted fluorescent lamp 4, the bonding unit 407 is provided in a total of three locations, namely, between two bulbs having the electrodes 410, between two legs of another bulb, and between two legs of yet another bulb, to thereby bond the arc tube 401 and the protrusion 406 together. Also, an adhesive may be injected between bridge-connected bulbs to bond the arc tube 401 and the protrusion 406 together. In so doing, the arc tube 401 is securely attached to the protrusion 406, and the bridge connection unit 409 is protected from damage.

(5) The above embodiment describes the case where the protrusion has a flat surface, but the present invention is not limited to such. For example, the protrusion may have an irregular surface. This increases the surface area of the protrusion, thereby increasing the contact area between the protrusion and the bonding unit. As a result, the arc tube and the holder can be bonded to each other more reliably.

In the case of the modification (3), for example, the side of the protrusion may be made uneven such that the outside diameter of the protrusion repeatedly increases and decreases in the longitudinal direction of the lamp. The bonding unit is caught in depressions formed on the side of the protrusion, and as a result adheres to the protrusion more securely. This further strengthens the bonding between the holder and the arc tube.

(6) The above embodiment describes the case where a vertical printed circuit board is inserted in the protrusion, but the present invention is not limited to this. For example, a horizontal printed circuit board may be used instead. In such a case, only the circuit components contained on the horizontal printed circuit board may be positioned in the protrusion. Alternatively, an expansion board may be formed on the horizontal printed circuit board, with this expansion board being positioned in the protrusion. In this case, the expansion board may be formed so that its main surface is in parallel with or orthogonal to a main surface of the horizontal printed circuit board.

(7) The above embodiment describes the case where the arc tube is curved in a double spiral, but this is not a limit for the present invention, which can be equally applicable to other types of arc tubes.

Figure 6A:
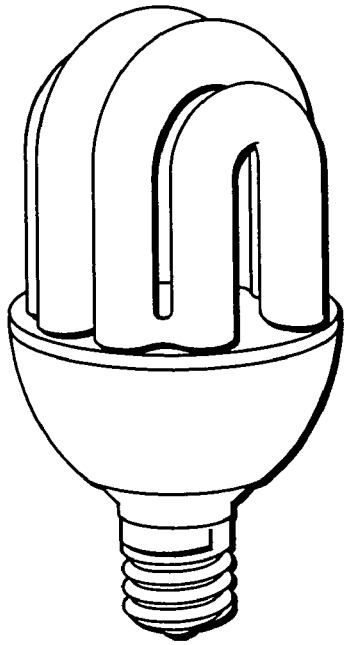
FIGS. 6A to 6C are perspective views of appearances of compact self-ballasted fluorescent lamps according to a modification (7) to the embodiment.
Figure 6B:
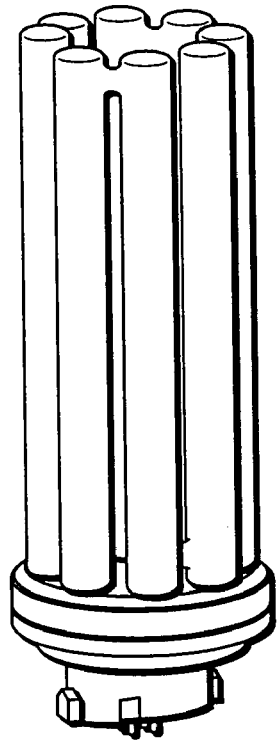
Figure 6C:
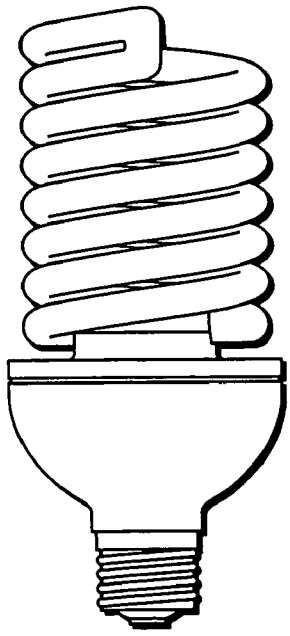

FIGS. 6A to 6C show appearances of compact self-ballasted fluorescent lamps to which this modification relates.

FIG. 6A shows a compact self-ballasted fluorescent lamp having an arc tube which is formed by bridge-connecting four U-shaped bulbs. The effects described above can be achieved by providing a protrusion of a holder in a space surrounded by this arc tube and bonding the protrusion to the arc tube by a bonding unit.

FIG. 6B shows a compact self-ballasted fluorescent lamp having an arc tube which is formed by bridge-connecting eight straight bulbs. The effects described above can be achieved by providing a protrusion of a holder in a space surrounded by this arc tube and bonding the protrusion to the arc tube by a bonding unit.

FIG. 6C shows a compact self-ballasted fluorescent lamp having a double-spiral arc tube which is turned in a different manner from the one used in the above embodiment. The effects described above can be achieved by providing a protrusion of a holder in a space surrounded by this arc tube and bonding the protrusion to the arc tube by a bonding unit.

Thus, so long as there is a space surrounded by an arc tube, the above effects can be achieved by providing a protrusion of a holder in that space and bonding the arc tube and the protrusion using a bonding unit, irrespective of what shape the arc tube takes.

(8) The above embodiment describes the case where a screw base is used, though it should be obvious that the present invention is not limited to this. The effects described above can equally be achieved using other bases, e.g. a bayonet base.

(9) The protrusion is surrounded by the arc tube and so is exposed to a high temperature. This being so, circuit components that cannot ensure normal operation at about 150° C. or above are preferably not housed in the protrusion.

Generally, circuit components such as an electrolytic capacitor and an inductor having a small wire diameter cannot ensure normal operation at a temperature of 150° C. or above. Therefore, these circuit components are preferably not housed in the protrusion. Meanwhile, circuit components such as a choke coil and a transistor can operate normally even if the temperature is 150° C. or above, and so are suitable to be contained in the protrusion. Here, if these circuit components are positioned in contact with an inner wall of the protrusion, heat from the circuit components is allowed to escape to the protrusion. By helping the heat dissipation of the circuit components in this way, the normal operations of the circuit components can be guaranteed.

Note here that, as explained earlier in the modification (1), the electrolytic capacitor may be housed in the protrusion so long as the temperature in the protrusion does not exceed the upper temperature limit of the electrolytic capacitor during operation, i.e., before the arc tube reaches the end of its life. According to this construction, high heat generated from the arc tube at the end of its life disables the electrolytic capacitor, with it being possible to stop the operation of the lighting circuit safely.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A low-pressure mercury vapor lamp comprising:

an arc tube having electrodes at both ends and forming one curved discharge path inside;

a holder having two openings in which the ends of the arc tube are respectively inserted, and a tubular protrusion that is surrounded by the arc tube;

an adhesive bonding unit adhering the arc tube and the protrusion of the holder;

a lighting circuit having an exothermic component that is positioned inside the protrusion, and a base, wherein the adhesive bonding unit adheres the protrusion to an upper portion of the arc tube, the upper portion protruding from the holder in a direction away from the base.

2. The low-pressure mercury vapor lamp of claim 1, wherein the ends of the arc tube are inserted in the openings of the holder without being adhered to the holder.

3. The low-pressure mercury vapor lamp of claim 1, wherein the protrusion has a closed end, and the adhesive bonding unit adheres the end of the protrusion to a part of the arc tube facing the end of the protrusion.

4. The low-pressure mercury vapor lamp of claim 1, wherein the adhesive bonding unit adheres a side of the protrusion to a part of the arc tube facing the side of the protrusion.

5. The low-pressure mercury vapor lamp of claim 1, wherein a part of the protrusion that is adhered by the adhesive bonding unit has an irregular surface.

6. The low-pressure mercury vapor lamp of claim 1 further comprising a lighting circuit having a choke coil and a transistor, wherein at least one of the choke coil and the transistor is positioned inside the protrusion.

7. The low-pressure mercury vapor lamp of claim 6, wherein the at least one of the choke coil and the transistor is in contact with an inner wall of the protrusion.

8. The low-pressure mercury vapor lamp of claim 1, wherein the exothermic component is in contact with an inner wall of the protrusion.

9. The low-pressure mercury vapor lamp of claim 1, wherein the exothermic component is at least one of a choke coil and a transistor.

10. The low-pressure mercury vapor lamp of claim 1, wherein the lighting circuit has a voltage doubler that includes an electrolytic capacitor, and the electrolytic capacitor is positioned inside the protrusion, instead of or in addition to the exothermic component.

11. The low-pressure mercury vapor lamp of claim 1, wherein the adhesive bonding unit adheres the protrusion to a vicinity of a coldest-spot of the arc tube.

12. The low-pressure mercury vapor lamp of claim 1, wherein the arc tube is in a double-spiral shape.

13. A low-pressure mercury vapor lamp comprising:

an arc tube having electrodes at both ends and for forming one curved discharge path inside;

a holder having two openings in which the ends of the arc tube are respectively inserted, and a tubular protrusion that is surrounded by the arc tube;

an adhesive bonding unit adhering the arc tube to the protrusion of the holder;

a lighting circuit having an exothermic component that is positioned inside the protrusion; and a base, wherein the arc tube is in a double-spiral shape, the protrusion has a closed end, and the adhesive bonding unit adheres the end of the protrusion to an upper part of the arc tube facing the end of the protrusion.

14. A low-pressure mercury vapor lamp comprising:

an arc tube having electrodes at both ends and forming one curved discharge path inside;

a holder having two openings in which the ends of the arc tube are respectively inserted, and a tubular protrusion that is surrounded by the arc tube;

an adhesive bonding unit adhering the arc tube to the protrusion of the holder;

a lighting circuit having an exothermic component that is positioned inside the protrusion; and a base, wherein the arc tube is in a U shape, the protrusion has a closed end, and the adhesive bonding unit adheres a side of the protrusion at least to an upper part of the arc tube facing the side of the protrusion.

* * * * *

UNITED STATES PATENT AND TRADEMARK OFFICE

CERTIFICATE OF CORRECTION

PATENT NO. : 7,598,662 B2
APPLICATION NO. : 11/075971
DATED : October 6, 2009
INVENTOR(S) : Miki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 609 days.

Signed and Sealed this

Twenty-eighth Day of September, 2010

David J. Kappos

David J. Kappos
*Director of the United States Patent and Trademark Office*